US009085130B2

(12) United States Patent
Chen et al.

(10) Patent No.: US 9,085,130 B2
(45) Date of Patent: Jul. 21, 2015

(54) OPTIMIZED INTERNALLY-FED HIGH-SPEED ROTARY PRINTING DEVICE

(71) Applicant: The Procter & Gamble Company, Cincinnati, OH (US)

(72) Inventors: Haibin Chen, West Chester, OH (US); Thomas Timothy Byrne, West Chester, OH (US); Mark Stephen Conroy, Colerain Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 74 days.

(21) Appl. No.: 14/038,933

(22) Filed: Sep. 27, 2013

(65) Prior Publication Data

US 2015/0090138 A1 Apr. 2, 2015

(51) Int. Cl.
*B41F 31/22* (2006.01)
*B41F 9/00* (2006.01)
(Continued)

(52) U.S. Cl.
CPC ..... *B41F 9/003* (2013.01); *B41F 9/061* (2013.01); *B41F 31/22* (2013.01); *B41J 2/315* (2013.01); *B41F 13/11* (2013.01); *B41F 31/26* (2013.01)

(58) Field of Classification Search
CPC ..... B41F 31/22
See application file for complete search history.

(56) References Cited

U.S. PATENT DOCUMENTS 1,867,314 A 7/1932 Gurwick
2,217,552 A * 10/1940 Horton ..... 101/367
(Continued)

FOREIGN PATENT DOCUMENTS

EP 1 075 948 B1 9/2005
EP 1 673 225 B1 8/2008
(Continued)

OTHER PUBLICATIONS

PCT International Search Report dated Dec. 22, 2014—53 pages.

*Primary Examiner* — Jill Culler
(74) *Attorney, Agent, or Firm* — Peter D. Meyer

(57) ABSTRACT

A rotary device for high-speed printing or coating of a web substrate is disclosed. The printing system provides a gravure roll rotatable about an axis at a surface velocity, v, and a fluid channel having a pressure drop throughout the fluid channel due to friction, $P_f$, disposed therein. The fluid channel is disposed generally parallel to the axis at a distance, $R_{in}$, relative to the axis. The fluid channel provides fluid communication of a fluid having a fluid vapor pressure, $P_v$, and a fluid density, ρ, from a first position external to the gravure roll to a web substrate contacting surface of the gravure roll. The web substrate contacting surface is located at a distance, $R_{out}$, relative to the axis. $R_{in}$ is determined from the relationship:

$$\frac{R_{in}}{R_{out}} > \sqrt{1 - \frac{2(P_{out} - P_v + P_f)}{\rho v^2}}$$

where $P_{out}$=static pressure of the fluid channel at the web substrate contacting surface.

20 Claims, 4 Drawing Sheets

(51) Int. Cl.

| | |
|---|---|
| ***B41F 9/06*** | (2006.01) |
| ***B41J 2/315*** | (2006.01) |
| *B41F 31/26* | (2006.01) |
| *B41F 13/11* | (2006.01) |

(56) References Cited

U.S. PATENT DOCUMENTS

| | | | | | |
|---|---|---|---|---|---|
| 2,226,163 | A | | 12/1940 | DuFour | |
| 2,319,616 | A | * | 5/1943 | Luehrs | 101/367 |
| 2,427,765 | A | | 9/1947 | Chollar | |
| 2,468,400 | A | | 4/1949 | Huebner | |
| 2,864,310 | A | | 12/1958 | Nelson | |
| 3,055,296 | A | | 9/1962 | Farrow | |
| 3,056,384 | A | | 10/1962 | Beale | |
| 3,294,016 | A | | 12/1966 | Heonis | |
| 3,301,746 | A | | 1/1967 | Sanford et al. | |
| 3,473,576 | A | | 10/1969 | Amneus | |
| 3,573,164 | A | | 3/1971 | Friedberg et al. | |
| 3,738,269 | A | | 6/1973 | Wagner | |
| 3,812,782 | A | * | 5/1974 | Funahashi | 101/367 |
| 3,821,068 | A | | 6/1974 | Shaw | |
| 3,896,722 | A | | 7/1975 | Farrow | |
| 3,896,723 | A | | 7/1975 | Farrow et al. | |
| 3,974,025 | A | | 8/1976 | Ayers | |
| 3,994,771 | A | | 11/1976 | Morgan, Jr. et al. | |
| 4,033,258 | A | | 7/1977 | Farrow | |
| 4,191,609 | A | | 3/1980 | Trokhan | |
| 4,191,756 | A | | 3/1980 | Masi et al. | |
| 4,239,065 | A | | 12/1980 | Trokhan | |
| 4,300,981 | A | | 11/1981 | Carstens | |
| 4,361,089 | A | | 11/1982 | Wittkopf et al. | |
| 4,399,751 | A | * | 8/1983 | Kessler | 101/367 |
| 4,437,408 | A | | 3/1984 | Arkans | |
| 4,440,597 | A | | 4/1984 | Wells et al. | |
| 4,452,141 | A | | 6/1984 | Mistyurik | |
| 4,458,399 | A | | 7/1984 | Kessler | |
| 4,483,053 | A | | 11/1984 | Hamisch, Jr. | |
| 4,528,239 | A | | 7/1985 | Trokhan | |
| 4,529,480 | A | | 7/1985 | Trokhan | |
| 4,534,094 | A | | 8/1985 | Kessler | |
| 4,574,732 | A | | 3/1986 | Verwey et al. | |
| 4,599,627 | A | | 7/1986 | Vollert | |
| 4,637,859 | A | | 1/1987 | Trokhan | |
| 4,766,840 | A | | 8/1988 | Beckley et al. | |
| 4,812,899 | A | | 3/1989 | Kueppers | |
| 4,844,952 | A | | 7/1989 | Korenkiewicz et al. | |
| 4,878,977 | A | | 11/1989 | Kueppers | |
| 4,939,992 | A | | 7/1990 | Bird | |
| 5,082,703 | A | | 1/1992 | Longobardi | |
| 5,282,419 | A | | 2/1994 | Barrois | |
| 5,364,504 | A | | 11/1994 | Smurkoski et al. | |
| 5,429,686 | A | | 7/1995 | Chiu et al. | |
| 5,458,590 | A | | 10/1995 | Schleinz et al. | |
| 5,529,664 | A | | 6/1996 | Trokhan et al. | |
| 5,549,790 | A | | 8/1996 | Van Phan | |
| 5,556,509 | A | | 9/1996 | Trokhan et al. | |
| 5,580,423 | A | | 12/1996 | Ampulski et al. | |
| 5,609,725 | A | | 3/1997 | Van Phan | |
| 5,629,052 | A | | 5/1997 | Trokhan et al. | |
| 5,637,194 | A | | 6/1997 | Ampulski et al. | |
| 5,672,248 | A | | 9/1997 | Wendt et al. | |
| 5,674,663 | A | | 10/1997 | McFarland et al. | |
| 5,679,222 | A | | 10/1997 | Rasch et al. | |
| 5,693,187 | A | | 12/1997 | Ampulski et al. | |
| 5,695,855 | A | | 12/1997 | Yeo et al. | |
| 5,709,775 | A | | 1/1998 | Trokhan et al. | |
| 5,714,041 | A | | 2/1998 | Ayers et al. | |
| 5,733,634 | A | | 3/1998 | Karel | |
| 5,734,800 | A | | 3/1998 | Herbert et al. | |
| 5,776,307 | A | | 7/1998 | Ampulski et al. | |
| 5,795,440 | A | | 8/1998 | Ampulski et al. | |
| 5,814,190 | A | | 9/1998 | Van Phan | |
| 5,817,377 | A | | 10/1998 | Trokhan et al. | |
| 5,846,379 | A | | 12/1998 | Ampulski et al. | |
| 5,855,739 | A | | 1/1999 | Ampulski et al. | |
| 5,858,514 | A | | 1/1999 | Bowers | |
| 5,861,082 | A | | 1/1999 | Ampulski et al. | |
| 5,865,950 | A | | 2/1999 | Vinson et al. | |
| 5,871,887 | A | | 2/1999 | Trokhan et al. | |
| 5,897,745 | A | | 4/1999 | Ampulski et al. | |
| 5,904,811 | A | | 5/1999 | Ampulski et al. | |
| 5,906,161 | A | | 5/1999 | Kessler | |
| 5,906,710 | A | | 5/1999 | Trokhan | |
| 5,942,085 | A | | 8/1999 | Neal et al. | |
| 6,048,938 | A | | 4/2000 | Neal et al. | |
| 6,096,412 | A | | 8/2000 | McFarland et al. | |
| 6,173,646 | B1 | | 1/2001 | Tanaka et al. | |
| 6,187,138 | B1 | | 2/2001 | Neal et al. | |
| 6,234,078 | B1 | | 5/2001 | Kessler | |
| 6,281,269 | B1 | | 8/2001 | Schut | |
| 6,477,948 | B1 | | 11/2002 | Nissing et al. | |
| 6,610,131 | B2 | | 8/2003 | Harris et al. | |
| 6,993,964 | B2 | | 2/2006 | Franz et al. | |
| 7,611,582 | B2 | | 11/2009 | McNeil et al. | |
| 8,163,132 | B2 | | 4/2012 | Kien | |
| 2006/0008514 | A1 | | 1/2006 | Koenig et al. | |
| 2010/0126366 | A1 | * | 5/2010 | Kasper et al. | 101/350.2 |
| 2012/0222568 | A1 | | 9/2012 | Byrne et al. | |
| 2012/0222570 | A1 | * | 9/2012 | McNeil et al. | 101/153 |
| 2012/0222571 | A1 | * | 9/2012 | Byrne et al. | 101/153 |

FOREIGN PATENT DOCUMENTS

| | | |
|---|---|---|
| GB | 1176321 | 1/1970 |
| GB | 1241793 | 8/1971 |
| GB | 1241794 | 8/1971 |
| GB | 1350059 | 4/1974 |
| GB | 1396282 | 6/1975 |
| GB | 1439458 | 6/1976 |
| GB | 1468360 | 3/1977 |
| GB | 1570545 | 7/1980 |
| GB | 2314292 | 12/1997 |
| WO | WO 84/00516 | 2/1984 |
| WO | WO 99/54143 | 10/1999 |

* cited by examiner

OPTIMIZED INTERNALLY-FED HIGH-SPEED ROTARY PRINTING DEVICE

FIELD OF THE INVENTION

The present disclosure relates to internally-fed high-speed rotary devices. More particularly, the present disclosure relates to rotary devices used for high-speed printing or coating of a web substrate with a fluid of fluids that are provided from channels positioned within the rotary device.

BACKGROUND OF THE INVENTION

It is considered desirable to apply fluids and coatings to a moving web substrate from a rotating device. The selective transfer of such fluids and coatings for purposes such as printing is also desirable. Further, the selective transfer of a fluid to a surface by way of a permeable element is also desirable.

For example, screen printing provides for the transfer of a fluid to a surface through a permeable element. The design transferred in screen printing is formed by selectively occluding openings in the screen that are located according to the formation of the screen. The aspect ratio of the holes and fluid viscosity may limit the fluid types, application rate, or fluid dose that may be applied with screen printing.

Other fluid application efforts have utilized sintered metal surfaces as transfer elements. A pattern of permeability has been formed using the pores in the element. These pores may be generally closed by plating the material and then selectively reopened by machining a desired pattern upon the material and subsequently chemically etching the machined portions of the element to reveal the existing pores. In this manner a pattern of permeability corresponding to the pores initially formed in the material may be formed and used to selectively transfer fluid. The nature of the pores in a sintered material is generally so the tortuosity of the pores predisposes the pores to clogging by fluid impurities. The placement of the fluid is limited in the prior art to the pores or openings present in the material that may be selectively closed or generally closed and selectively reopened.

Gravure printing is also provides a method for transferring fluid to the surface of a moving web material. The use of fixed volume cells engraved onto the surface of a print cylinder can ensure high quality and consistency of fluid transfer over long run times. However, a given cylinder is limited in the range of flow rates possible per unit area of web surface.

Additional efforts directed toward a 'gravure-like' system have focused on the use of a roll having discrete cells disposed upon an outer surface. Each cell of the discrete cells receives a fluid from a position internal to the roll. Generally, the fluid is provided to the discrete cells by a channel disposed internally to the roll. These channels are usually provided parallel to the axis of rotation of the roll and are disposed in a region proximate to the axis of rotation of the roll. One reason for this arrangement is that one of skill in the art generally feeds fluids into a rotating device at a position near the axis of rotation. This provides the ability to incorporate such fluid feeds into the shaft that supports the rotating device.

Additionally, it is understood that generally, high rotational (line) speeds are considered by those of skill in the art as highly desirable for increased production rates. However, it was found that when current rotary systems, such as the exemplary gravure printing system described supra, are filled with a fluid and rotate at a high circumferential speed, the centrifugal force was found to create a region(s) of low pressure (i.e., "pull a vacuum") in the fluid channels, or those portions of the fluid channels, that are disposed in regions proximate to the axis of rotation of the rotating device. This region of low pressure is thought to provide three undesirable phenomena in operations where high rotational velocities are required:

1. When the rotating device reaches a certain rotational speed, the local pressure in any channel, or portion(s) thereof, disposed within the rotating device that are proximate to the axis of rotation is reduced below the vaporization pressure of the fluid at the local temperature. The fluid is caused to vaporize and form gas bubbles. This phenomenon can be considered to be analogous to the cavitation observed in a hydraulic pump operating at high rpm.
2. If the fluid is not deaerated properly, the size of any entrained air bubbles in the fluid will increase as the pressure drops.
3. According to Henry's law, the amount of air dissolved in a fluid is proportional to the local pressure. When a fluid transported from a position external to the rotary device to the center of the rotary device through a channel disposed within the rotating device, the pressure exerted upon the fluid changes from atmospheric to a near vacuum. Part of this dissolved air can then be released in the form of bubbles in the fluid.

According to the ideal gas law, the gas or air bubble volume is inversely proportional to the local pressure. Therefore, the size of bubbles within the fluid will increase as the rotational speed increases. This is because the pressure in any fluid channels, or portions thereof, located in the region near the rotational axis decreases as the rotational speed increases. These gas or air bubbles introduce difficulties in high rotational speed operations, such as printing and coating. These can include undesirable flowrates, partial blockages within the internal roll piping, noise, vibration, and damage to the piping network. The latter can be considered analogous to the damage due to cavitation caused by an impeller.

Thus, one of skill in the art will recognize that such undesired phenomena caused by these centrifugal forces, such as those described supra, must be controlled to enhance the speed and performance of equipment used in material processing technologies. A design that controls and increases the performance of high-speed rotary unions is needed in manufacturing. Clearly, a design that can correlate equipment design, fluid dynamics, and high-speed manufacturing is needed.

The rotary device of the present disclosure overcomes these problems associated with the prior art by providing a rotary device for use in a fluid delivery system that is capable of transporting single or multiple fluids and controlling the pressure drop due to high-speed rotation of internally-fed rolls at the fluid inputs, and prevents the creation of a region(s) of low pressure in an economical manner. The disclosed rotary device can be modified to accommodate different numbers of flow channels and is designed to ensure efficient rotation between incoming and outgoing conduit arrangements.

SUMMARY OF THE INVENTION

The present disclosure provides a printing system for printing a fluid onto the surface of a web substrate. The printing system comprises a gravure roll rotatable about an axis at a surface velocity, v, and a fluid channel having a pressure drop throughout the fluid channel due to friction, $P_f$, disposed therein. The fluid channel is disposed generally parallel to the axis at a distance, $R_{in}$, relative to the axis. The fluid channel provides fluid communication of a fluid having a fluid vapor pressure, $P_v$, and a fluid density, ρ, from a first position external to the gravure roll to a web substrate contacting surface of the gravure roll. The web substrate contacting surface is located at a distance, $R_{out}$, relative to the axis. $R_{in}$ is determined from the relationship:

$$\frac{R_{in}}{R_{out}} > \sqrt{1 - \frac{2(P_{out} - P_v + P_f)}{\rho v^2}}$$

where:

$P_{out}$=static pressure of the fluid channel at the web substrate contacting surface.

The present disclosure also provides a printing system for printing a fluid onto the surface of a web substrate. The printing system comprises a gravure roll rotatable about an axis at a surface velocity, ν, and a fluid channel having a pressure drop throughout the fluid channel due to friction, $P_f$, disposed therein. A portion of the fluid channel is disposed at a distance, $R_{in}$, relative to the axis. The fluid channel provides fluid communication of a fluid having a fluid vapor pressure, $P_v$, and a fluid density, ρ, from a first position external to the gravure roll to a web substrate contacting surface of the gravure roll. The web substrate contacting surface is located at a distance, $R_{out}$, relative to the axis. $R_{in}$ is determined from the relationship:

$$\frac{R_{in}}{R_{out}} > \sqrt{1 - \frac{2(P_{out} - P_v + P_f)}{\rho v^2}}$$

where:

$P_{out}$=static pressure of the fluid channel at the web substrate contacting surface.

DETAILED DESCRIPTION

According to the present description, it is believed that controlling the vaporization (e.g., the formation of gas or air bubbles) in liquids disposed in elongate pipes that can be rotated about an axis essentially perpendicular to the elongate pipe can be achieved by advancing the mathematical foundation of the pressures in such systems. In order to understand and evaluate the fluid vaporization process and use the results to describe the unique rotary device described herein, a review of the forces involved in the movement of fluidic media through a pipe (or fluid channel) both generally perpendicular to, and rotating about, an axis of rotation is necessary. Using these results to design a rotary device suitable for use in high rotational velocity applications can result in the prevention or reduction of fluid vaporization by careful selection of the position at which a fluid traverses through, and exits, a rotary device relative to the axis of rotation of the rotary device (such as an internally-fed gravure roll). This involves the deliberate design of the fluid distribution networks that provide the fluid communication of a fluid from a position external to the rotating device, internally through the rotating device, and subsequently depositing the fluid upon the surface of the rotating device from a position located within the rotary device.

Figure 1:
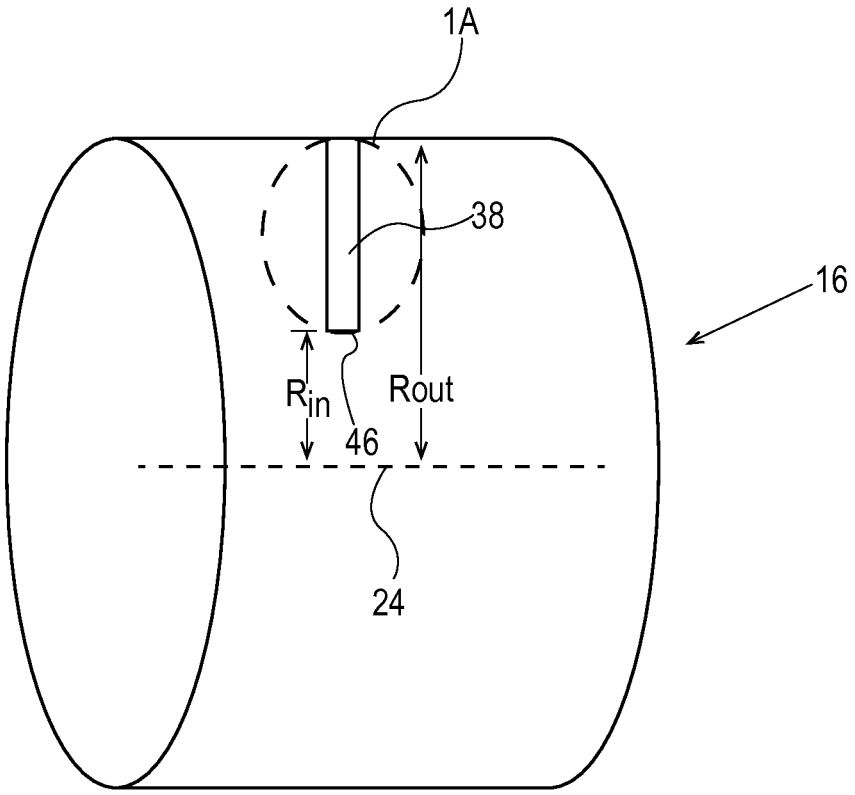
FIG. 1 is an exemplary rotating device having an exemplary pipe contained within used to demonstrate the forces in a pipe containing a fluid and used to derive Equation 15 infra.
Figure 1A:
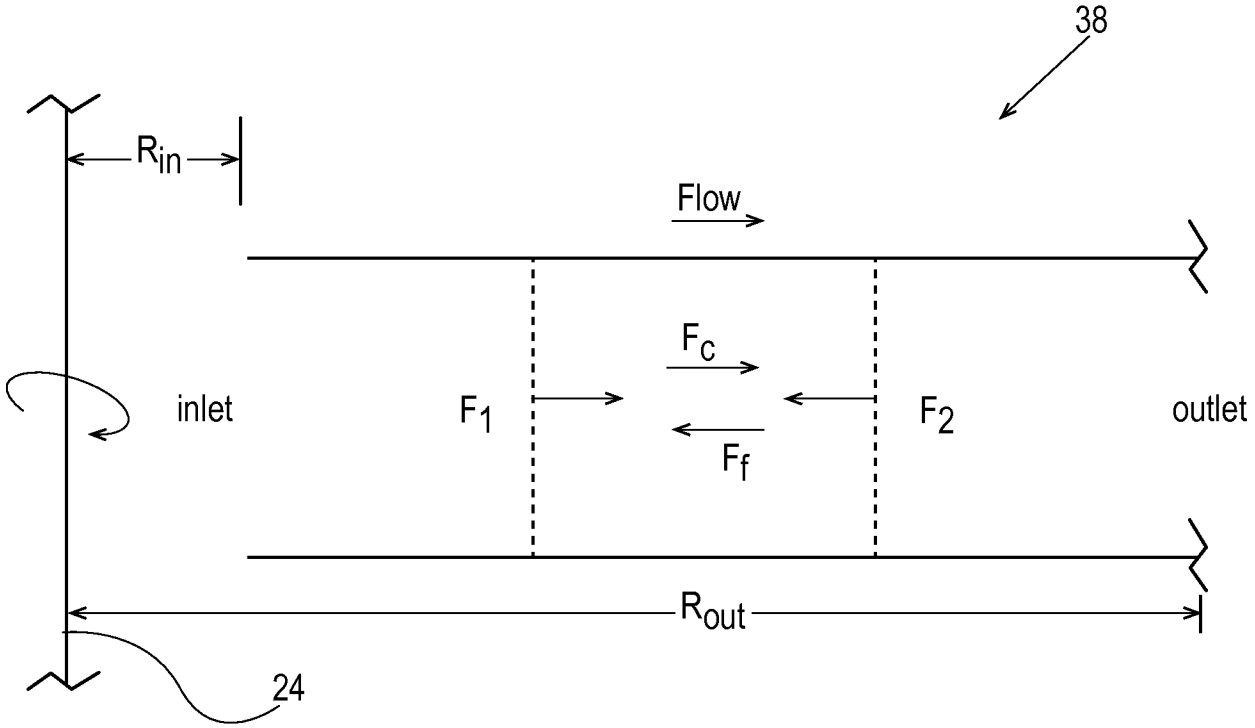
FIG. 1A is an exemplary pipe used to demonstrate the forces present in a pipe containing a fluid and disposed within the exemplary rotating device of FIG. 1 and used to derive Equation 15 infra.

FIG. 1 depicts an exemplary rotating device 16 having a fluid channel (or pipe) 38 capable of containing and transporting a fluid disposed therein. The fluid channel 38 has an inlet 46 disposed at a distance, $R_{in}$, relative to the axis of rotation 24 and an outlet disposed at a distance, $R_{out}$, relative to the axis of rotation 24. FIG. 1A shows a system force balance analysis over an infinitesimal region of the fluid channel 38 of FIG. 1 disposed generally perpendicular to an axis of rotation 24. The fluid channel 38, filled with a fluid, generally rotates about the axis of rotation 24. In other words, the fluid channel 38 orbits about the axis of rotation 24. The force balances can be expressed as:

$$F_1+F_c=F_2+F_f \qquad \text{Equation 1}$$

where:

$F_1$ and $F_2$=Forces at sides of the infinitesimal fluid region due to the static pressure, $F_c$=centrifugal force, and $F_f$=resistance force due to the friction.

The centrifugal force can be rewritten as:

$$F_c=m*a \qquad \text{Equation 2}$$

where:

m=mass of the fluid in the specific region, and a=acceleration due to the rotation.

The acceleration due to the rotation, a, can be calculated from $$a=\omega^2 R \qquad \text{Equation 3}$$

where:

ω=angular velocity, and

R=distance from the axis of rotation to the center of the infinitesimal fluid region.

Thus, Equation 1 can be rewritten as:

$$P\pi r^2+\rho\pi r^2\Delta R(\omega^2 R)=P_2\pi r^2+F_f \qquad \text{Equation 4}$$

where:

$P_1$ and $P_2$=static pressure at sides of the infinitesimal fluid region,

ρ=fluid density, and r=radius of the pipe.

For simplicity, we can assume a cylindrical pipe to derive Equation 4. However, one of skill in the art will recognize that the following equations and results are independent of the cross-sectional shape of the pipe. Thus, dividing both sides of the equation by the cross sectional area $\pi r^2$, Equation 4 can be rewritten as:

$$\rho\Delta R(\omega^2 R)=P_2-P_1\Delta P_f \qquad \text{Equation 5}$$

where:

$\Delta P_f$=pressure drop in the infinitesimal region due to the friction.

After integrating the left-hand side and right-hand side from the pipe inlet position to outlet position, we have:

$$\int_{R_{in}}^{R_{out}} \rho\omega^2 R dR = P_{out} - P_{in} + P_f \quad \text{Equation 6}$$

where:

$R_{in}$ and $R_{out}$=the radius relative to the axis of rotation at pipe inlet and outlet respectively, $P_{in}$ and $P_{out}$=the static pressure at pipe inlet and outlet respectively, and $P_f$=the pressure drop throughout the pipe due to friction.

$P_f$ can be found by one of skill in the art in suitable engineering handbooks. Alternatively, one of skill in the art can calculate $P_f$ from the Hagen-Poiseuille equation if the flow through a long, constant cross section cylindrical pipe is laminar. For reference, the Hagen-Poiseuille equation is:

$$P_f = \frac{8\mu l Q}{\pi r^4} \quad \text{Equation 7}$$

where:

μ=fluid viscosity, l=pipe length, r=internal radius of the pipe and

Q=volumetric flow rate.

From Equation 6, we now have:

$$\tfrac{1}{2}\rho\omega^2(R_{out}^2 - R_{in}^2) = P_{out} - P_{in} + P_f \quad \text{Equation 8}$$

The roll surface velocity, ν, can be calculated from $$\nu = \omega R_{out} \quad \text{Equation 9}$$

By substituting surface velocity, ν, (Equation 9) into Equation 8, one obtains:

$$\frac{1}{2}\rho v^2\left(1 - \left(\frac{R_{in}}{R_{out}}\right)^2\right) = P_{out} - P_{in} + P_f \quad \text{Equation 10}$$

After rearrangement, one has:

$$\left(\frac{R_{in}}{R_{out}}\right)^2 = 1 - \frac{2(P_{out} - P_{in} + P_f)}{\rho v^2} \quad \text{Equation 11}$$

To use a pipe to deliver a fluid, $P_{in}$ must be higher than fluid vapor pressure, $P_v$, at the applied temperature. Otherwise, the liquid at the inlet will undergo vaporization. Therefore it is reasonable to presume that $P_{in} > P_v$.

Therefore Equation 11 can be rewritten as:

$$\left(\frac{R_{in}}{R_{out}}\right)^2 > 1 - \frac{2(P_{out} - P_v + P_f)}{\rho v^2} \quad \text{Equation 12}$$

One of skill in the art will appreciate that two options exist relative to Equation 12; namely—

$$1 - \frac{2(P_{out} - P_v + P_f)}{\rho v^2} \le 0 \text{ and } 1 - \frac{2(P_{out} - P_v + P_f)}{\rho v^2} > 0.$$

In the case of the latter relationship (e.g., $$1 - \frac{2(P_{out} - P_v + P_f)}{\rho v^2} > 0$$

(i.e., is a positive, greater than zero value)) vaporization of the fluid is possible. The net effect is that $R_{in}$ must be a non-zero value (i.e., $R_{in}$ is displaced radially away from the axis of rotation). In other words:

$$1 - \frac{2(P_{out} - P_v + P_f)}{\rho v^2} > 0. \quad \text{Equation 13}$$

Using an exemplary fluid suitable for use with the present invention (e.g., $H_2O$ @ 25° C.), it can be presumed that frictional losses through the pipe, $P_f$, are negligibly small (i.e., near zero). Using $H_2O$ @ 25° C. for an example, one can define a theoretical critical rotational velocity, $\nu_c$, for an exemplary rotary system where the exemplary fluid is provided in a channel positioned internal to a rotary device (e.g., the rotary gravure system described supra) and the rotary device deposits the water onto a substrate contacting the rotary device from the internal channel at atmospheric pressure:

$$v_c = \sqrt{\frac{2(P_{out} - P_v + P_f)}{\rho}} = 14 \text{ m/s} = 2755 \text{ ft/min} \quad \text{Equation 14}$$

where known tabulated values are:

$P_{out}$=101325 Pa (atmospheric pressure @ STP), $P_v$=3200 Pa (e.g., $H_2O$ vapor pressure at 25° C.), and ρ=1000 kg/m$^3$ (for $H_2O$ @ 25° C.).

Thus, in order to prevent the deleterious effects discussed supra, ν<2755 ft/min for $H_2O$ @ 25° C. This rotational velocity limitation can prevent the use of rotational speeds greater than 2755 ft/min for $H_2O$ @ 25° C. for a manufacturing operation due to vaporization of the fluid within the pipe.

When the surface velocity has the relationship $\nu > \nu_c$, we see that a pipe design within a rotating object must satisfy the following equation:

$$\frac{R_{in}}{R_{out}} > \sqrt{1 - \frac{2(P_{out} - P_v + P_f)}{\rho v^2}} \quad \text{Equation 15}$$

for $H_2O$ @ 25° C. to prevent liquid from vaporizing at the pipe inlet.

Additionally, it is preferred that:

$$\frac{R_{in}}{R_{out}} < 1 \quad \text{Equation 16}$$

for $H_2O$ @ 25° C.

In addition, it is useful to note the following additional relationships:

Henry's Law states the gas dissolved in liquid is proportional to the partial pressure of the gas:

$$p = k_H c \quad \text{Equation 17}$$

where:

p is the partial pressure of the gas in equilibrium with the liquid;

$k_H$ is Henry's constant;

c is the dissolved gas concentration (e.g. oxygen and nitrogen).

The equation for the ideal equation of state:

$$PV=n\acute{R}T \quad \text{Equation 18}$$

where:

P is the pressure of the gas;

V is the volume of the gas;

n is the amount of substance amount of substance of gas (also known as number of moles);

T is the temperature of the gas; and, $\acute{R}$ is the ideal, or universal, gas constant.

Figure 2:
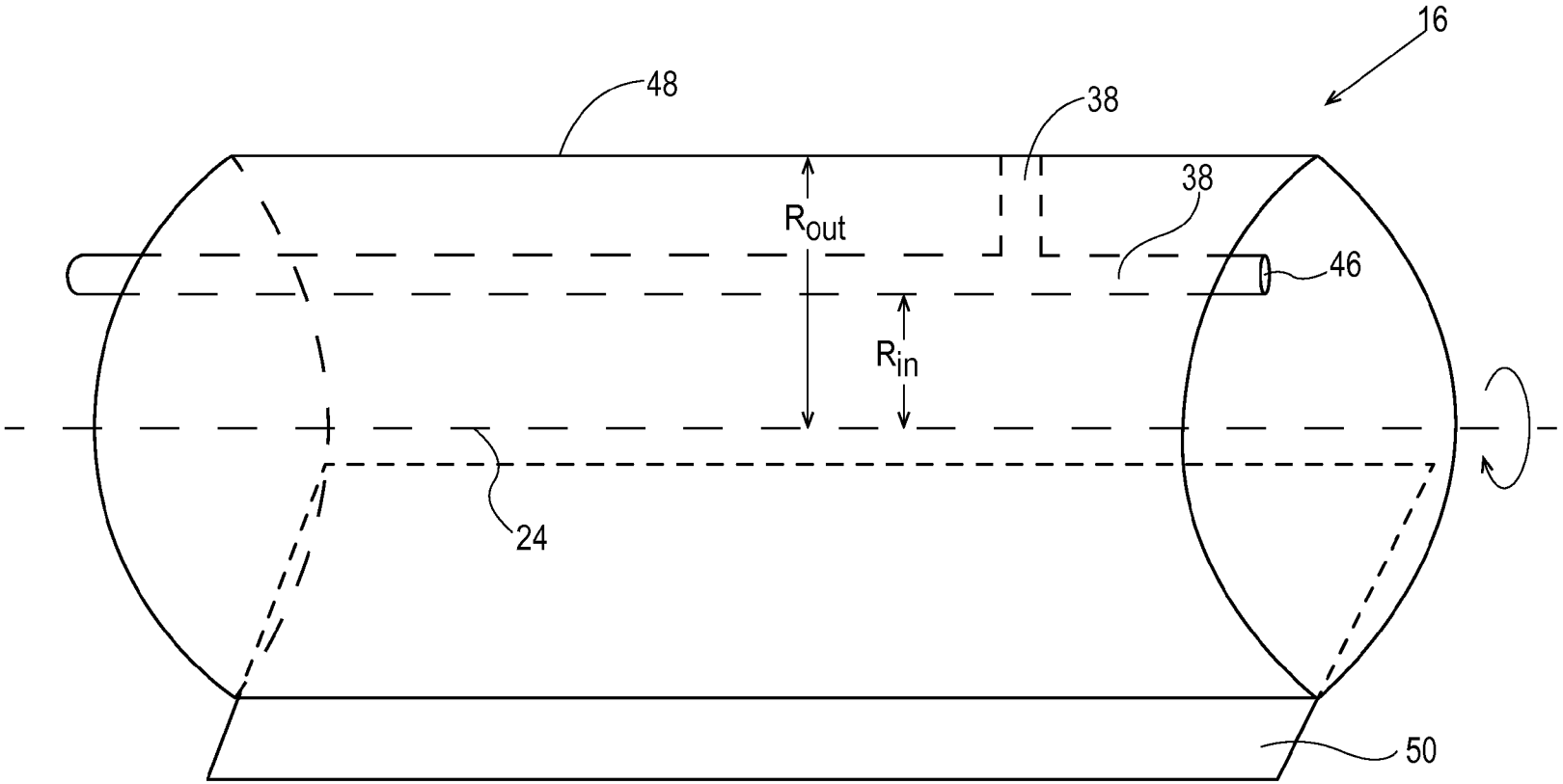
FIG. 2 is an exemplary pipe design through a rotating device showing an exemplary $R_{in}$ and $R_{out}$; and, FIG. 3 provides alternative exemplary pipe designs through a rotating device in contact with a web substrate and showing another exemplary $R_{in}$ and $R_{out}$.
Figure 3:
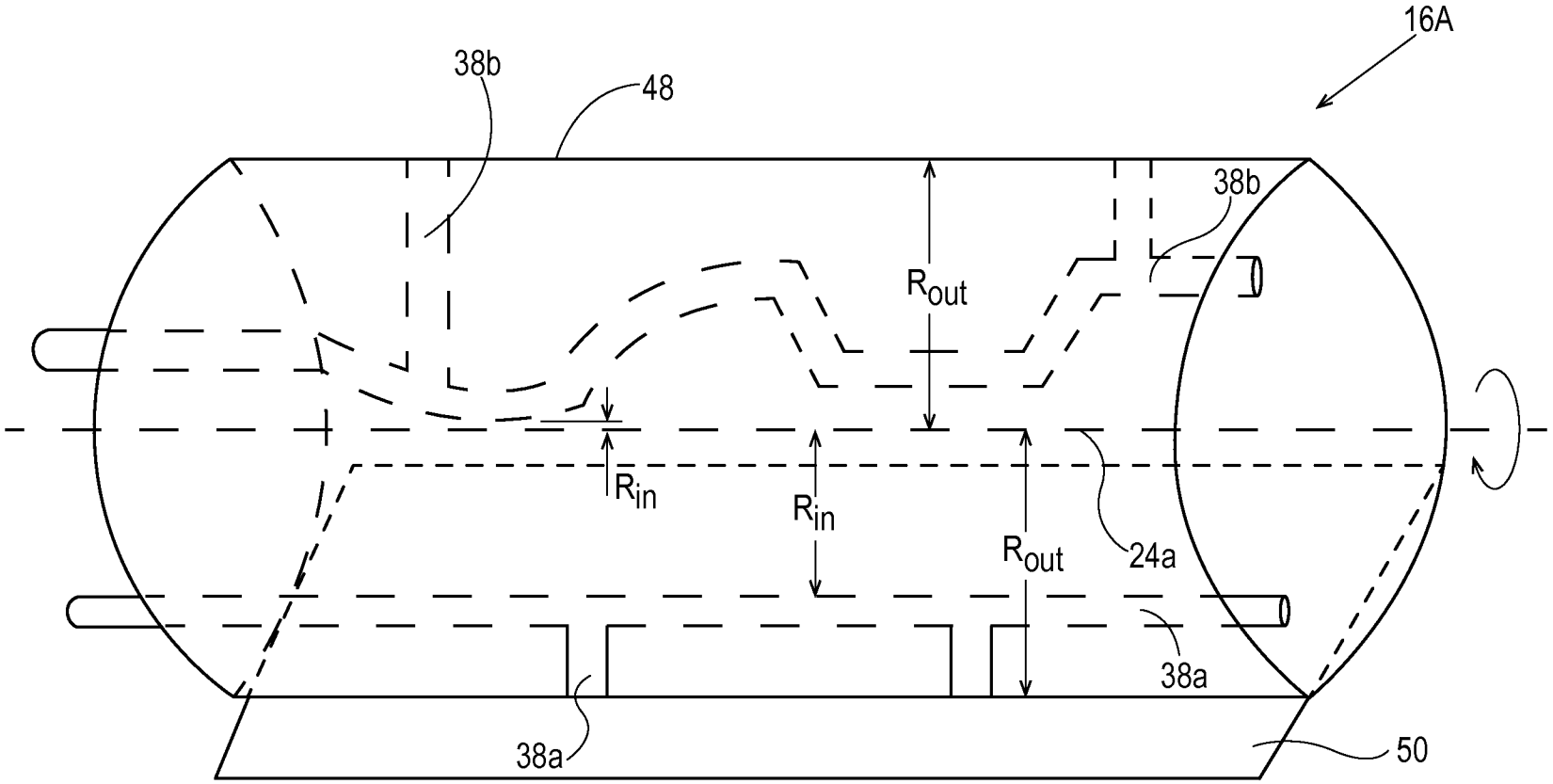

As shown, FIG. 2 provides a representative drawing showing the relationships between $R_{in}$, $R_{out}$, and the axis of rotation 24 in an exemplary rotating device 16 having a single fluid channel 38 that is generally parallel to and rotates about an axis of rotation 24. A representative drawing showing the above relationship between $R_{in}$ and $R_{out}$ of an exemplary rotary device 16*a* having two fluid channels 38*a*, 38*b* rotating about an axis of rotation 24*a* is shown FIG. 3. As shown in FIG. 3, it is not necessary that the entirety, or even any defined portion, of exemplary fluid channel 38*b* be continuously parallel (i.e., collinear) to the axis of rotation 24*a*.

Referring to FIGS. 2 and 3, using the mathematical derivation discussed above, for purposes of the present disclosure, the value of $R_{in}$ can be determined as the distance between the axis of rotation 24, 24*a* and the point at which any portion of a particular fluid channel 38, 38*a*, 38*b* disposed within rotating device 16, 16*a* and having an opening disposed upon the surface of rotating device 16, 16*a* comes closest to the axis of rotation 24, 24*a*. It should be recognized that each fluid channel 38, 38*a*, 38*b* that may be present within a given rotating device 16, 16*a* can have its own associated $R_{in}$ (i.e., $R_{in}$, $R_{in2}$, etc.) as well as pressure drop throughout the respective fluid channel 38, 38*a*, 38*b* (i.e., $P_f$, $P_{f2}$, etc.). As shown in FIG. 3, it should be recognized that there can be deviations in the distance that portions of exemplary fluid channel 38*b* (defined microscopically) may be disposed from the axis of rotation 24*a*, the general direction of flow of fluidic material macroscopically through the rotating device 16*a* may be considered to be generally parallel to the axis of rotation 24*a*. Stated another way, fluid channel 38, 38*a*, 38*b* or any particular portion thereof is not required to be parallel with axis of rotation 24, 24*a*.

Referring to FIGS. 2 and 3, using the mathematical derivation discussed above, for purposes of the present disclosure, the value of $R_{out}$ can be determined as the distance between the axis of rotation 24, 24*a* and the point at which a particular fluid channel 38, 38*a*, 38*b* disposed within rotating device 16, 16*a* terminates upon the web-contacting surface 48 of rotating device 16, 16*a* relative to the axis of rotation 24, 24*a*. Each fluid channel 38, 38*a*, 38*b* that may be present within a given rotating device 16, 16*a* can have at least one portion thereof that will be in fluid communication with the surface 48 of the rotating device 16, 16*a* and be disposed at a radial distance of $R_{out}$ from the axis of rotation 24, 24*a*. It should be recognized that each fluid channel 38, 38*a*, 38*b* that may be present within a given rotating device 16, 16*a* can have its own associated $R_{out}$ (i.e., $R_{out}$, $R_{out2}$, etc.) and a respective static pressure at the web substrate 50 contacting surface 48 (i.e., $P_{out}$, $P_{out2}$, etc.).

Rotating device 16 can be used to provide an exemplary contact printing system. Such contact printing systems are generally formed from printing components that displace a fluid onto a web substrate 50 or article (also known to those of skill in the art as a 'central roll') and other ancillary components necessary assist the displacement of the fluid from the central roll onto the substrate in order to, for example, print an image onto the substrate. In providing an exemplary printing component commensurate in scope with the apparatus of the present disclosure, rotating device 16 can be provided as a gravure cylinder. The envisioned gravure cylinder can be used to carry a desired pattern and quantity of ink and transfer a portion of the ink to a web material 50 that has been placed in contact with the surface 48 of the gravure cylinder which in turn transfers the ink to the web material 50.

In any regard, the rotating device 16 of the present disclosure can be ultimately used to apply a broad range of fluids to a web substrate at a target rate and in a desired pattern. By way of non-limiting example, a contact printing system commensurate in scope with the present disclosure can apply more than just a single fluid (e.g., can apply a plurality of individual inks each having a different color or a plurality of individual inks mixed and/or combined internally to rotating device 16, 16*a*) to form an ink having an intermediate color) to a web substrate when compared to a conventional gravure printing system as described supra (e.g., can only apply a single ink). Each fluid can have a respective fluid density (i.e., $\rho$, $\rho_2$, etc.) and respective vapor pressure (i.e., $P_v$, $P_{v2}$, etc.).

The rotating device 16 described herein can be applied in concert with other components suitable for additional processes related to printing processes or other converting operations known to those of skill in the art. Further, numerous design features can be integrated to provide a configuration that prints multiple fluids (such as inks) upon a web substrate 50 by the same rotating device 16. A surprising and clear benefit that would be understood by one of skill in the art is the elimination of the fundamental constraint of flexographic or gravure print systems where a separate print deck is required for each and every color. The apparatus described herein is uniquely capable of providing all of the intended graphic benefits of a gravure printing system without all of the drawbacks discussed supra.

The rotating device 16 of the present disclosure can also be provided with a multi-port rotary union. The use of a multi-port rotary union can provide the capability of delivering more than one fluid to a respective fluid channel 38 or fluid channels 38 disposed within rotating device 16. It would be recognized by one of skill in the art that a preferred multi-port rotary union should be capable of feeding the desired number of fluids (e.g., colors) to each fluid channel 38 associated with rotating device 16. One of skill in the art will understand that a conventional multi-port rotary union suitable for use with the present invention can typically be provided with up to forty-four passages and are suitable for use up to 7,500 lbs. per square inch of ink pressure.

It should be noted that individual fluid channels 38 may be combined with another fluid channel 38 or fluid channels 38 at any point along their respective lengths. In effect, this is a combining of the fluid streams associated with each individual fluid channels 38 that can provide for the mixing of individual fluids to produce a third fluid that has the characteristics desired for the end use. For example a red ink and a blue ink can be combined in situ within the fluid channels 38 disposed within rotating device 16 to produce violet.

In one embodiment the fluid channels 38 may be formed by the use of electron beam drilling as is known in the art. Electron beam drilling comprises a process whereby high energy electrons impinge upon a surface resulting in the formation of holes through the material. In another embodiment the fluid channels 38 may be formed using a laser. In another embodiment the fluid channels 38 may be formed by using a conventional mechanical drill bit. In yet another embodiment the fluid channels 38 may be formed using electrical discharge machining as is known in the art. In yet another embodiment the fluid channels 38 may be formed by chemical etching. In still yet another embodiment the fluid channels 38 can be formed as part of the construction of a rapid prototyping process such as stereo lithography/SLA, laser sintering, or fused deposition modeling.

In one embodiment the fluid channels 38 may have portions that are substantially straight and normal to the outer surface of the rotating device 16. In another embodiment the fluid channels 38 can be provided at an angle other than 90 degrees from the outer surface of the rotating device 16. In each of these embodiments each of the fluid channels 38 has a single exit point at the surface 48 of rotating device 16.

One of skill in the art will understand that state-of-the-art rotary devices 16 may include laser engraved ceramic rolls and laser engraved carbon fiber within ceramic coatings. In either case, the cell geometry (e.g., shape and size of the opening at the outer surface, wall angle, depth, etc.) are preferably selected to provide the desired target flow rate, resolution, and ink retention in a rotating device 16 rotating at high speed.

As mentioned previously, currently available rotary contact systems utilize ink pans or enclosed fountains to fill the individual cells disposed within the surface of the rotary contact system with an ink or other fluid from a position disposed away from the surface of the rotary contact system. The aforementioned doctor blades wipe off excess ink such that the ink delivery rate is primarily a function of cell geometry. While this may provide a relatively uniform ink application rate, it also provides no adjustment capability to account for changes in ink chemistry, viscosity, substrate material variations, operating speeds, and the like. Thus, it was surprisingly found by the inventors of the instant disclosure that the disclosed technology may reapply certain capabilities of anilox and gravure cell technology in a modified permeable roll configuration. In any regard, as shown in FIGS. 2 and 3, a particular fluid can be fed to the surface 48 of rotating device 16 from a fluid channel 38 underlying the surface 48 of rotating device where the fluid channel is provided in accordance with Equation 15, supra.

In one embodiment the fluid channel 38 is provided by electron beam drilling and may have an aspect ratio of at least about 25:1. For example, a fluid channel 38 having an aspect ratio of 25:1 has a length 25 times the diameter of the fluid channel 38. In this embodiment the fluid channel 38 may have a diameter of between about 0.001 inches (0.025 mm) and about 0.030 inches (0.75 mm) The fluid channel 38 may contact the surface 48 at an angle of between about 20 and about 90 degrees relative to the surface 48 of rotating device 16. The fluid channel 38 may be accurately positioned upon the surface of the rotating device 16 to within 0.0005 inches (0.013 mm) of the desired non-random pattern of permeability.

In one embodiment the fluid channel 38 has an aspect ratio ranging from about 25:1 to at least about 60:1. In this embodiment holes 0.005 inches (0.13 mm) in diameter may be electron beam drilled in a metal shell about 0.125 inches (3 mm) in thickness. Metal plating may subsequently be applied to the surface of the shell. The plating may reduce the nominal fluid channel 38 diameter from about 0.005 inches (0.13 mm) to about 0.002 inches (0.05 mm).

The accuracy with which the opening of fluid channel 38 disposed upon the surface 48 of rotating device 16 enables the permeable nature of the rotating device 16 to be decoupled from the inherent porosity of the rotating device 16. The permeability of the rotating device 16 may be selected to provide a particular benefit via a particular fluid application pattern to web substrate 50. Locations for the fluid channel 38 may be determined to provide a particular array of permeability in the rotating device 16. This array may permit the selective transfer of fluid droplets formed at fluid channel 38 to a fluid receiving surface of a moving web substrate 50 brought into contact with the fluid droplets.

It was surprisingly found that a rotating device 16 can be manufactured in the form of a unibody construction that incorporates the desired geometry for the rotating device 16 and/or the desired geometry for the surface 48 of rotating device 16 and/or the desired geometry of each fluid channel 38 disposed therein. Such unibody constructions typically enable building parts one layer at a time through the use of typical techniques such as SLA/stereo lithography, SLM/Selective Laser Melting, RFP/Rapid freeze prototyping, SLS/Selective Laser sintering, SLA/Stereo lithography, EFAB/Electrochemical fabrication, DMDS/Direct Metal Laser Sintering, LENS®/Laser Engineered Net Shaping, DPS/Direct Photo Shaping, DLP/Digital light processing, EBM/Electron beam machining, FDM/Fused deposition manufacturing, MJM/Multiphase jet modeling, LOM/Laminated Object manufacturing, DMD/Direct metal deposition, SGC/Solid ground curing, JFP/Jetted photo polymer, EBF/Electron Beam Fabrication, LMJP/liquid metal jet printing, MSDM/Mold shape deposition manufacturing, SALD/Selective area laser deposition, SDM/Shape deposition manufacturing, combinations thereof, and the like.

It should be recognized by one familiar in the art that such a unibody rotating device 16 can be constructed using these technologies by combining them with other techniques known to those of skill in the art such as casting. As a non-limiting example, using an "inverse roll" the desired fluid passageways desired for a particular rotating device 16 could be fabricated and then the desired rotating device 16 materials could be cast around the passageway fabrication. In this manner a passageway fabrication providing the desired geometry for the fluid channels 38 can be can be created to provide the hollow fluid channels 38 for rotating device 16. A non-limiting variation of this process could include the steps of providing the passageway fabrication with a soluble material that could then be dissolved once the final casting has hardened to create the rotating device 16 having the desired fluid channels 38 disposed therein.

In still yet another non-limiting example, sections of the rotating device 16 could be fabricated separately and combined into a final rotating device 16 assembly. This can facilitate assembly and repair work to the parts of the rotating device 16 such as coating, machining, heating and the like, etc. before they are assembled together to make a complete contact printing system such as rotating device 16. In such techniques, two or more of the components of a complete rotating device 16 commensurate in scope with the instant disclosure can be combined into a single integrated part.

Alternatively, and by way of another non-limiting example, the rotating device 16 could similarly be constructed as a unibody structure where fluid communication is manufactured in situ to provide a structure that is integrated and includes any fluid channels 38 necessary for the desired fluid application to a web substrate 50. One or more fluid channels 38 can then be provided to fluidly communicate a fluid from one position upon the surface 48 of rotary device 16 to another position disposed upon the surface 48 of rotating device 16 for contacting a web substrate 50.

As used herein, "web substrate" includes products suitable for the manufacture of articles upon which indicia may be imprinted thereon and substantially affixed thereto. Web materials suitable for use and within the intended disclosure include fibrous structures, absorbent paper products, and/or products containing fibers. Other materials are also intended to be within the scope of the present invention as long as they do not interfere or counter act any advantage presented by the instant invention. Suitable web materials may include foils, polymer sheets, cloth, wovens or nonwovens, paper, cellulose fiber sheets, co-extrusions, laminates, high internal phase emulsion foam materials, and combinations thereof. The properties of a selected deformable material can include, though are not restricted to, combinations or degrees of being: porous, non-porous, microporous, gas or liquid permeable, non-permeable, hydrophilic, hydrophobic, hydroscopic, oleophilic, oleophobic, high critical surface tension, low critical surface tension, surface pre-textured, elastically yieldable, plastically yieldable, electrically conductive, and electrically non-conductive. Such materials can be homogeneous or composition combinations.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A printing system for printing a fluid onto the surface of a web substrate, said printing system comprising a gravure roll rotatable about an axis at a surface velocity, v, and a first fluid having a first fluid vapor pressure, $P_v$, and a first fluid density, ρ, the gravure roll comprising a fluid channel having a pressure drop throughout said fluid channel due to friction, $P_f$, disposed therein, said fluid channel being disposed generally parallel to said axis at a distance, $R_{in}$, relative to said axis, said fluid channel providing fluid communication of said first fluid from a first position external to said gravure roll to a web substrate contacting surface of said gravure roll, said web substrate contacting surface being located at a distance, $R_{out}$, relative to said axis, and wherein said $R_{in}$ is determined from the relationship:

$$\frac{R_{in}}{R_{out}} > \sqrt{1 - \frac{2(P_{out} - P_v + P_f)}{\rho v^2}}$$

where:

$P_{out}$=static pressure of said fluid channel at said web substrate contacting surface.

2. The printing system of claim 1 wherein $$\frac{R_{in}}{R_{out}} < 1.$$

3. The printing system of claim 1 wherein said first fluid is disposed upon said web substrate from said web contacting surface.

4. The printing system of claim 1 wherein said gravure roll comprises a second fluid channel disposed therein, said second fluid channel having a second pressure drop throughout said fluid channel due to friction, $P_{f2}$, and disposed generally parallel to said axis at a second distance, $R_{in2}$, relative to said axis, said second fluid channel providing fluid communication of a second fluid having a second fluid vapor pressure, $P_{v2}$, and a second fluid density, $\rho_2$, from a second position external to said gravure roll to a second position upon said web substrate contacting surface of said gravure roll, said second position upon said web substrate contacting surface being located at a second distance, $R_{out2}$, relative to said axis, and wherein said second distance, $R_{in2}$, is determined from the relationship:

$$\frac{R_{in2}}{R_{out2}} > \sqrt{1 - \frac{2(P_{out2} - P_{v2} + P_{f2})}{\rho 2 v^2}}$$

where:

$P_{out2}$=static pressure of said second fluid channel at said second position upon said web substrate contacting surface.

5. The printing system of claim 4 wherein $$\frac{R_{in2}}{R_{out2}} < 1.$$

6. The printing system of claim 1 further comprising a rotary union, said rotary union providing fluid communication of said first fluid to said fluid channel from a second position external to said gravure roll.

7. The printing system of claim 1 wherein said fluid channel has an aspect ratio of at least about 25:1.

8. The printing system of claim 1 wherein said printing system is provided as a unibody construction.

9. The printing system of claim 8 wherein said printing system is manufactured by a technique selected from the group consisting of SLA/stereo lithography, SLM/Selective Laser Melting, RFP/Rapid freeze prototyping, SLS/Selective Laser sintering, SLA/Stereo lithography, EFAB/Electrochemical fabrication, DMDS/Direct Metal Laser Sintering, LENS®/Laser Engineered Net Shaping, DPS/Direct Photo Shaping, DLP/Digital light processing, EBM/Electron beam machining, FDM/Fused deposition manufacturing, MJM/Multiphase jet modeling, LOM/Laminated Object manufacturing, DMD/Direct metal deposition, SGC/Solid ground curing, JFP/Jetted photo polymer, EBF/Electron Beam Fabrication, LMJP/liquid metal jet printing, MSDM/Mold shape deposition manufacturing, SALD/Selective area laser deposition, SDM/Shape deposition manufacturing, combinations thereof, and the like.

10. The printing system of claim 8, wherein said printing system is manufactured in situ.

11. The printing system of claim 1 wherein said printing system is manufactured as a plurality of sections, each of said plurality of sections being cooperatively combined to form said printing system.

12. A printing system for printing a fluid onto the surface of a web substrate, said printing system comprising a gravure roll rotatable about an axis at a surface velocity, v, and a first fluid having a first fluid vapor pressure, $P_v$, and a first fluid density, ρ, the gravure roll comprising a fluid channel having a pressure drop throughout said fluid channel due to friction, $P_f$, disposed therein, a portion of said fluid channel being disposed at a distance, $R_{in}$, relative to said axis, said fluid channel providing fluid communication of said first fluid from a first position external to said gravure roll to a web substrate contacting surface of said gravure roll, said web substrate contacting surface being located at a distance, $R_{out}$, relative to said axis, and wherein said $R_{in}$ is determined from the relationship:

$$\frac{R_{in}}{R_{out}} > \sqrt{1 - \frac{2(P_{out} - P_v + P_f)}{\rho v^2}}$$

where:

$P_{out}$=static pressure of said fluid channel at said web substrate contacting surface.

13. The printing system of claim 12 wherein $$\frac{R_{in2}}{R_{out2}} < 1.$$

14. The printing system of claim 12 wherein said first fluid is disposed upon said web substrate from said web contacting surface.

15. The printing system of claim 12 wherein said gravure roll comprises a second fluid channel disposed therein, said second fluid channel having a second pressure drop throughout said fluid channel due to friction, $P_{f2}$, and disposed generally parallel to said axis at a second distance, $R_{in2}$, relative to said axis, said second fluid channel providing fluid communication of a second fluid having a second fluid vapor pressure, $P_{v2}$, and a second fluid density, $\rho_2$, from a second position external to said gravure roll to a second position upon said web substrate contacting surface of said gravure roll, said second position upon said web substrate contacting surface being located at a second distance, $R_{out2}$, relative to said axis, and wherein said second distance, $R_{in2}$, is determined from the relationship:

$$\frac{R_{in2}}{R_{out2}} > \sqrt{1 - \frac{2(P_{out2} - P_{v2} + P_{f2})}{\rho 2 v^2}}$$

where:

$P_{out2}$=static pressure of said second fluid channel at said second position upon said web substrate contacting surface.

16. The printing system of claim 15 further comprising a rotary union, said rotary union providing fluid communication of said first fluid to said fluid channel from a second position external to said gravure roll.

17. The printing system of claim 12 wherein said fluid channel has an aspect ratio of at least about 25:1.

18. The printing system of claim 12 wherein said printing system is provided as a unibody construction.

19. The printing system of claim 18 wherein said printing system is manufactured by a technique selected from the group consisting of SLA/stereo lithography, SLM/Selective Laser Melting, RFP/Rapid freeze prototyping, SLS/Selective Laser sintering, SLA/Stereo lithography, EFAB/Electrochemical fabrication, DMDS/Direct Metal Laser Sintering, LENS®/Laser Engineered Net Shaping, DPS/Direct Photo Shaping, DLP/Digital light processing, EBM/Electron beam machining, FDM/Fused deposition manufacturing, MJM/Multiphase jet modeling, LOM/Laminated Object manufacturing, DMD/Direct metal deposition, SGC/Solid ground curing, JFP/Jetted photo polymer, EBF/Electron Beam Fabrication, LMJP/liquid metal jet printing, MSDM/Mold shape deposition manufacturing, SALD/Selective area laser deposition, SDM/Shape deposition manufacturing, combinations thereof, and the like.

20. The printing system of claim 18, wherein said printing system is manufactured in situ.

* * * * *